United States Patent [19]

Dagon

[11] Patent Number: 4,844,519

[45] Date of Patent: Jul. 4, 1989

[54] DOOR LOCK WITH LOCKING PIN

[76] Inventor: Alfred P. Dagon, 2202 Francine Ave., Joliet, Ill. 60436

[21] Appl. No.: 237,475

[22] Filed: Aug. 29, 1988

Related U.S. Application Data

[63] Continuation-in-part of Ser. No. 151,640, Feb. 2, 1988, abandoned.

[51] Int. Cl.[4] ..... E05C 19/00

[52] U.S. Cl. ..... 292/57; 16/266; 16/380; 292/302

[58] Field of Search ..... 292/302, DIG. 9, DIG. 17, 292/288, 57, 59; 16/380, 386, 266

[56] References Cited

U.S. PATENT DOCUMENTS

| | | | |
|---|---|---|---|
| 238,168 | 2/1881 | Sibrey | 292/57 |
| 777,456 | 12/1904 | Wands | 292/57 |
| 996,497 | 6/1911 | Machin | 292/59 X |
| 1,083,455 | 1/1914 | Mohn | 292/57 |
| 1,351,117 | 8/1920 | Newhall | 292/302 |
| 1,622,791 | 3/1927 | Lang | 292/59 |
| 3,744,085 | 7/1973 | Griego | 16/386 X |
| 3,811,157 | 5/1974 | Schenk | 16/266 X |
| 4,013,311 | 3/1977 | Prezioso | 292/302 X |
| 4,015,868 | 4/1977 | Buttler | 292/302 |
| 4,603,452 | 8/1986 | Paciorek | 16/386 X |
| 4,627,651 | 12/1986 | Grimbly | 292/302 X |
| 4,630,333 | 12/1986 | Vickers | 16/386 X |

FOREIGN PATENT DOCUMENTS

| | | | |
|---|---|---|---|
| 21913 | 8/1947 | Finland | 292/302 |
| 356464 | 2/1938 | Italy | 16/386 |

*Primary Examiner*—Lloyd A. Gall
*Attorney, Agent, or Firm*—Ernest Kettelson

[57] ABSTRACT

A door lock comprising a first thin plate having connecting channels secured to the side wall of the door jamb and a second thin plate having corresponding connecting channels secured to the side wall of the door adjacent its swinging edge in position for registration of its connecting channels with those of the first thin plate when the door is in its closed position. A locking pin is received through the connecting channels of both plates when they are brought into registration with each other to thereby hold the door in its closed position until the locking pin is withdrawn. The outwardly facing surface of the first plate secured to the door jamb and the surfaces of its connecting channels which face toward the swinging edge of the door when in its closed position are preferably coplanar to prevent those surfaces of the first plate's connecting channels from protruding into the swinging path of the door as it is opened and closed. The connecting channels may be cylindrical in cross-section to receive a cylindrical pin. They may also be angular in cross-section to received a pin of corresponding angular cross-section such as square or triangular. Selected ones of the connecting channels may have a different cross-sectional configuration than adjacent ones, and the locking pin may have correspondingly configured cross-sectional segments to require precise alignment by pre-determinable rotation of the locking pin to insert and withdraw. The locking pin can thereby not be withdrawn without knowing how to properly rotate for the correct alignment.

1 Claim, 3 Drawing Sheets

FIG. 2
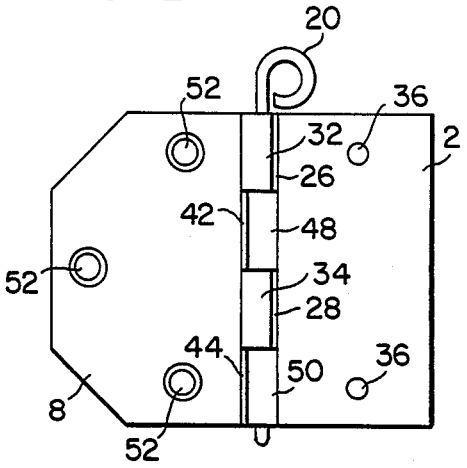
FIG. 3
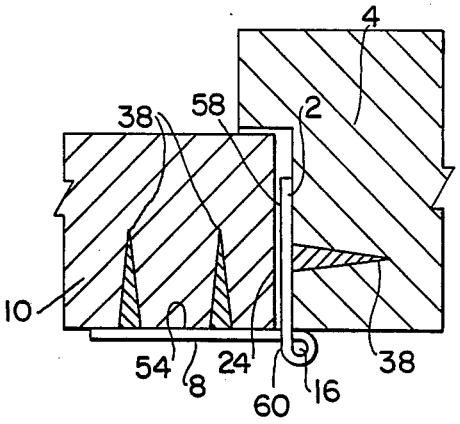
FIG. 4
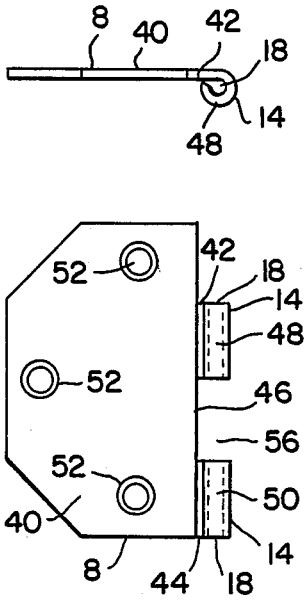
FIG. 5
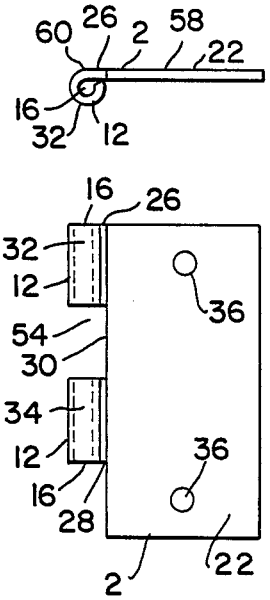
FIG. 6
FIG. 7

DOOR LOCK WITH LOCKING PIN

PRIOR APPLICATIONS

This application is a continuation in part of co-pending application Ser. No. 151,640 filed Feb. 2, 1988, now abandoned.

BACKGROUND OF THE INVENTION

This invention relates to the field of door locks, and particularly of the kind sometimes known as security locks which can only be reached for locking and unlocking from one side of the door.

Prior art devices of this kind include those disclosed in the following United States patents called to the inventor's attention during prosecution of Ser. No. 151,640:

U.S. Pat. No. 4,015,868 discloses a lock assembly having a pair of hinge plates connected by a cylindrical hinge pin. The connecting channels of the plate secured to the wall of the door jamb protrude part way into the swinging path of the door to prevent opening and closing without damage to the door.

U.S. Pat. No. 4,627,651 discloses a strike plate and face plate of a door lock in which both have apertures which come into registration when the door is closed to receive a lock bolt.

U.S. Pat. No. 2,038,462 discloses a door latch having a construction which makes it useable with either right-hand or left-hand doors.

U.S. Pat. No. 4,013,311 discloses a lock with a crossbar mounted on a door and a keeper mounted on the door frame, having a pin to extend through slots in spaced apart ears of the keeper to seat in a groove of the crossbar received between the spaced apart ears of the keeper.

Door locks of the kind known to the proir art are relatively complex or they present problems when put in use, such as the one shown in U.S. Pat. No. 4,015,868 which has connecting channels that protrude part way into the swinging path of the door to prevent opening and closing without damage to the door.

The door lock in accordance with the present invention overcomes such problems by providing a lock assembly of simplified construction, comprising two plates having interlocking channels in which the interlocking channels are constructed and positioned entirely out of the swinging path of the door.

The door lock in accordance with this invention comprises a first thin plate for securing to the jamb or upright side wall of a door frame and which is sandwiched between the outer swinging edge of the door and the door jamb when the door is closed, and a second similar thin plate for securing to the side wall of the door adjacent its outer swinging edge to align with said first plate when the door is closed.

The first thin plate has a first pair of spaced apart connecting arms extending out from the plate secured to the door jamb in the direction the door opens, the first pair of connecting arms terminating just beyond the door jamb in respective closed loops defining a first pair of axially aligned connecting channels.

The second thin plate has a second pair of spaced apart connecting arms extending out from this plate secured to the door in the direction toward the first pair of spaced apart connecting arms of the first thin plate when the door is in its closed position, the second pair of spaced apart connecting arms terminating just beyond the outer swinging edge of the door in respective closed loops defining a second pair of axially aligned connecting channels.

The uppermost connecting arms of one of the plates is received in the space between the connecting arms of the other of the connectable plates, and the lowermost connecting arm of the latter plate is received in the space between the connecting arms of the former plate, when the door is in its closed position. At such time, the connecting channels of all four connecting arms are axially aligned to provide a through channel to receive a locking pin. When the locking pin is inserted through the axially aligned connecting channels of all four of the connecting arms, the first and second plates are meshed and interlocked together to lock the door on which the second plate is secured to the door jamb on which the first plate is secured.

Each plate has three apertures to receive mounting screws therethrough to secure the first plate to the door jamb and to secure the second plate to the door.

The connecting channels of each connecting arm may all be cylindrical in cross-section to receive a locking pin of cylindrical cross-section. In the alternative, the connecting channels may be angular in cross-section to receive a locking pin of corresponding angular cross-section such as square or triangular. In a further alternative, selected ones of the connecting channels may have a cylindrical, square or other cross-section, and the locking pin may have a limited longitudinal portion of the same corresponding cross-section to pass through such selected one of the connecting channels after which the pin may be rotated out of alignment with such selected one of the connecting channels having the particularly configured cross-section. Two of the alternatively spaced apart connecting channels may have particularly configured cross-sections matching the cross-sections of two spaced apart longitudinal portions of the locking pin, whereby when the pin is positioned in only one pre-determined radial position its particularly configured cross-sections lines up with the particularly configured cross-sections of the alternatively spaced apart connecting channels so the locking pin can be inserted. The intervening connecting channels between those having the particularly configured cross-sections have an enlarged cross-section to permit rotation of the portion of the locking pin having the particularly configured cross-section when received in said intervening connecting channels. Thus, the locking pin can be rotated to rotate its particularly configured cross-sectional portions out of alignment with their respective connecting channels having the particularly configured cross-sections, thereby locking the locking pin in its interlocking position, interlocking both first and second plates together and the door to the door jamb. The locking pin cannot be removed and the door unlocked until the locking pin is rotated to the specific pre-determined radial position wherein the particularly configured cross-sectional portions of the pin and connecting channels are in alignment for withdrawal of the pin.

In another alternative, the leading insert end of the pin has a particularly configured cross-sectional configuration, such as square, and each alternative one of the inter-meshed connecting channels has a corresponding square cross-section but positioned relative to each other at different radial positions whereby the locking pin has to be rotated to one radial position to pass through a first one of such connecting channels, then being received in the enlarged cross-section of an adjacent connecting channel where it can be rotated to a second radial position for alignment with the next connecting channel having the particularly configured cross-section.

This construction protects against someone gaining entrance by breaking a hole through the door big enough to reach a hand through for withdrawal of the locking pin, or breaking the glass in doors having windows. The locking pin cannot be removed unless it is rotated into the specific pre-determined radial position, or series of different radial positions required for withdrawal.

SUMMARY OF THE INVENTION

It is an object of the invention to provide a door lock of simplified construction and easy to install, comprising two lockable plates each having a pair of spaced apart interlocking connecting channels for axial alignment when in the locking position and a locking pin receivable therein to lock the two plates together, the interlocking connecting channels being constructed and positioned entirely out of the swinging path of the door to which one of such plates is secured.

It is an object of the invention to provide a door lock comprising two lockable plates each having a plurality of spaced apart interlocking connecting channels for axial alignment when in the locking position to receive a locking pin therethrough, and means to prevent withdrawal of the locking pin until rotated to a particular radial position.

It is an object of the invention to provide a door lock comprising two lockable plates each having a plurality of spaced apart interlocking connecting channels for axial alignment when in the locking position to receive a locking pin therethrough, wherein the connecting channels have an angular cross-sectional configuration.

BRIEF DESCRIPTION OF THE DRAWING

FIG. 2 is an elevation view of a door lock in accordance with this invention.

FIG. 3 is a top end view of a door lock in accordance with this invention showing a fragment of a door and door jamb in section and the plates of the door lock secured thereto by mounting screws.

FIG. 4 is a top end view of the plate of the door lock in accordance with this invention which is to be secured to the door.

FIG. 5 is a top end view of the other plate of the door lock in accordance with this invention which is to be secured to the door jamb.

FIG. 6 is an elevation view of the plate shown in FIG. 4.

FIG. 7 is an elevation view of the plate shown in FIG. 5.

DESCRIPTION OF PREFERRED EMBODIMENT

Figure 1:
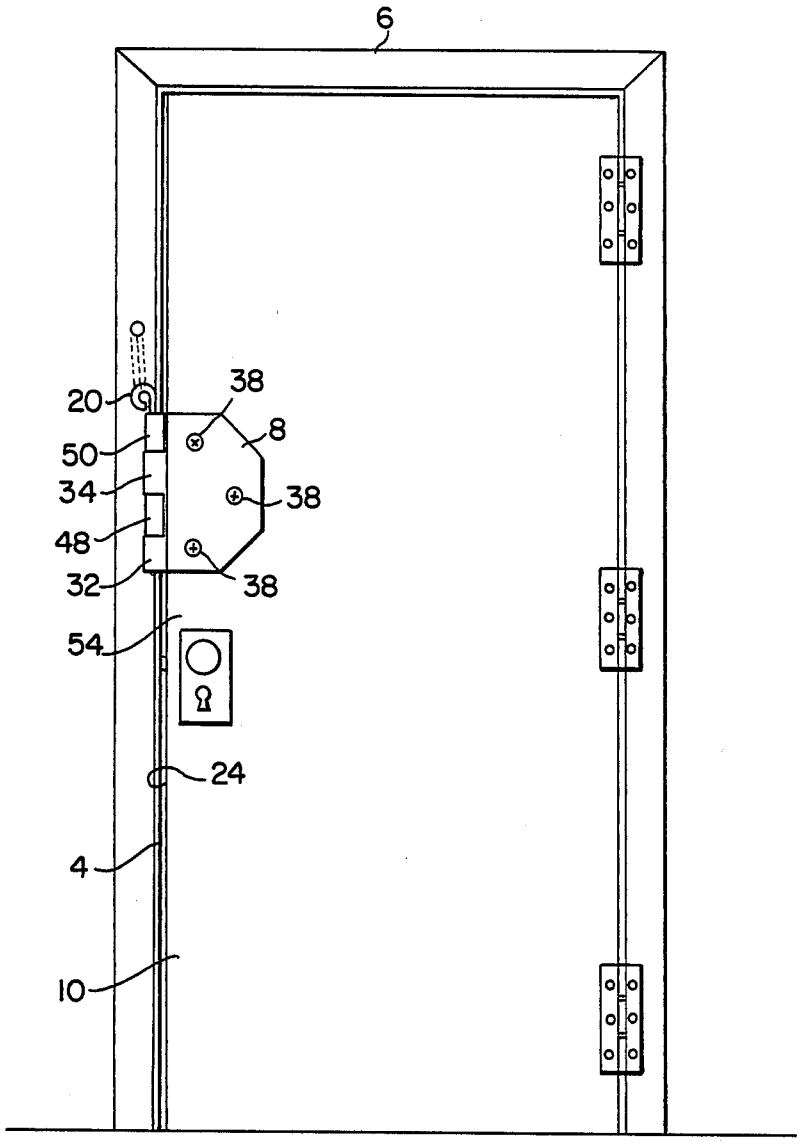
FIG. 1 is an elevation view of a door in closed position within a door frame showing a door lock in accordance with this invention in locked engagement.

A door lock in accordance with the present invention comprises a pair of metal plates having interlocking members, including a first plate 2 for securing to the door jamb 4 or upright wall of a door frame 6 and a second plate 8 for securing to the door 10 which is to be locked when the door is closed and the two metal plates 2 and 8 are brought together. At such time, the interlocking members 12 of the first plate 2 mesh with the interlocking members 14 of the second plate 8, and the interlocking channels 16 through interlocking members 12 of the first plate 2 are axially aligned with the interlocking channels 18 through interlocking members 14 of the second plate 8. A locking pin 20 is then inserted through the aligned interlocking channels 16 and 18 to lock the door in its closed position.

The first metal plate 2 comprises a body portion 22 of thin metal which can be sandwiched between the door jamb 4 and the outer swinging edge 24 of the door 10. The interlocking members 12 of the first plate 2 comprise a pair of spaced apart connecting arms 26 and 28 which extend outwardly from the connecting edge 30 of metal plate 2, and terminate in respective closed loops 32 and 34 which bound and define the interlocking channels 16 of the first plate 2 which are axially aligned with each other. The first plate 2 includes a pair of apertures 36 through the body portion 22 to receive wood screws 38 therethrough to secure the first plate 2 to the door jamb 4.

The second metal plate 8 comprises a body portion 40 of thin metal comparable in thickness to that of body portion 22 of metal plate 2. The interlocking members 14 of the second plate 8 comprise a pair of spaced apart connecting arms 42 and 44 which extend outwardly from the connecting edge 46 of the metal plate 8, and terminate in respective closed loops 48 and 50 which bound and define the interlocking channels 18 of the second plate 8 which are axially aligned with each other. The second plate 8 includes three apertures 52 through the body portion 40 to receive wood screws 38 therethrough to secure the second plate 8 to the side wall 54 of the door 10 adjacent its outer swinging edge 24, at a point thereon which brings the interlocking members 14 of the second plate 8 into interlocking engagement with the interlocking members 12 of the first plate 2 when the door 10 is moved to its closed position.

The connecting arms 26 and 28 of the first plate 2 and their respective closed loops 32 and 34 are spaced apart a distance corresponding to the longitudinal dimension of the connecting arms 42 and 44 of the second plate 8 and of their closed loops 48 and 50, whereby closed loop 48 of the second plate 8 is snugly received in the space 54 between closed loops 32 and 34 of the first plate 2, and closed loop 34 of the first plate 2 is snugly received in the space 56 between closed loops 48 and 50 of the second plate 8.

The outwardly facing surface 58 of the body portion 22 of plate 2 and the outwardly facing surface 60 of the connecting arms 26 and 28 of plate 2 are coplanar, whereby the closed loops 32 and 34 of plate 2 are positioned to one side of the swinging path of the door 10 when it is moved between its open and closed positions.

The closed loops 32 and 34 of plate 2 do not protrude into the swinging path of the door 10, whereby the outer swinging edge 24 of the door 10 is able to clear the closed loops 32 and 34 and cannot be damaged as happens with prior art devices in which corresponding connecting loops protrude into the swinging path of the door when the plate they extend from is secured to the door jamb surface which faces the outer swinging edge of the door in its closed position.

The cross-sectional configuration of the interlocking channels 16 of plate 2 and interlocking channels 18 of plate 8 may be circular or cylindrical, and in such case the cross-sectional configuration of the locking pin 20 is also circular or cylindrical.

The cross-sectional configuration of the interlocking channels 16 of plate 2 and interlocking channels 18 of plate 8 may in the alternative be angular, such as square or triangular, in which case the cross-sectional configuration of the locking pin 20 is also angular, such as square or triangular respectively.

In a modification of the invention, the interlocking channels 160 and 180 and the locking pin 220 are constructed so that the locking pin 220 has to be rotated to a pre-determined radius of rotation in order to be inserted and withdrawn, or rotated to a plurality of pre-determined radii during insertion and withdrawal.

Figure 10:
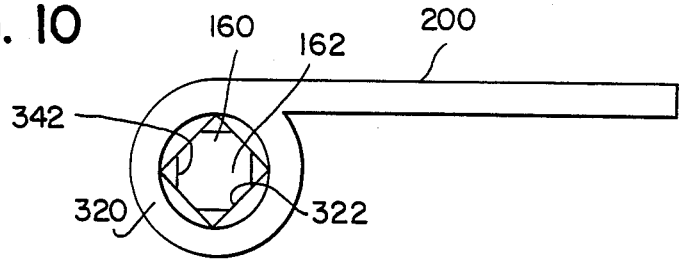
FIG. 10 is a top plan view of a modified plate in accordance with the invention for securing to the door jamb.
Figure 8:
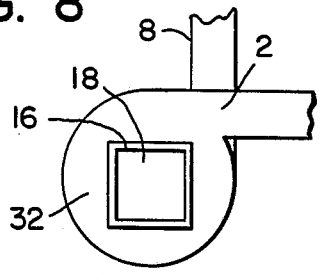
FIG. 8 is a top end view of a fragment of a door lock in accordance with this invention illustrating interlocking channels having a square cross-section.
Figure 9:
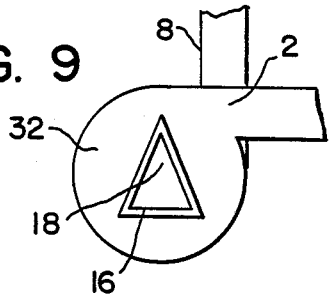
FIG. 9 is a top end view of a fragment of a door lock in accordance with this invention illustrating interlocking channels having a triangular cross-section.

FIG. 10 illustrates a modified first plate 200 in a top plan view in which the interlocking channel 160 of the upper closed loop 320 has a square cross-section bounded by four straight side walls 322 of equal dimension. The spaced apart lower closed loop 340 is not visible in the top plan view of FIG. 10 but portions of its four straight side walls 342 which bound its interlocking channel 162 are visible. The four straight side walls 342 of lower closed loop 340 are of equal dimension and define a square cross-section of interlocking channel 162. The side walls 322 of closed loop 320 and the side walls 342 of closed loop 340 are of equal dimension, and interlocking channels 160 and 162 have square cross-sections of equal dimension. The square cross-section channels 160 and 162 are axially aligned, but the side walls 342 of interlocking channel 162 are rotationally offset from the side walls 322 of interlocking channel 160 as can be seen in FIG. 10.

Figure 11:
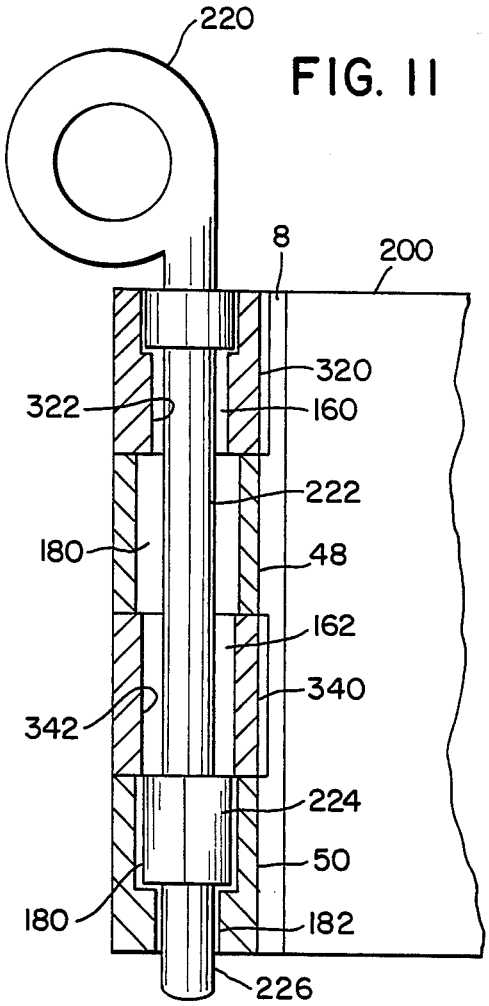
FIG. 11 is an elevation view of a modified locking pin for use with the modified plate shown in FIG. 10, showing the modified plate meshed with a plate shown in FIG. 6 and the modified locking pin fully seated in the interlocking channel and shown in section.

The modified locking pin 220 shown in FIG. 11 includes an elongated shank 222 having an enlarged portion 224 of square cross-section corresponding in configuration and dimension to that of the interlocking channels 160 and 162. The longitudinal dimension of the enlarged square cross-section portion 224 is less than the corresponding longitudinal dimension of the space 54 between the upper closed loop 320 and the lower closed loop 340 of the modified first plate 200.

The cross-sectional dimension of the enlarged square cross-section portion 224 of the modified locking pin 220 is smaller than the circular cross-sectional dimension of the interlocking channel 18 of the upper closed loop 48 of the second plate 8, whereby when the enlarged portion 224 of locking pin 220 reaches the interlocking channel 18 of closed loop 48 as it is being inserted and withdrawn it can be rotated to rotate the square cross-section portion 224 to any desired radius of rotation.

When inserting the modified locking pin 220 to lock the modified plate 200 secured on the door jamb 4 to the plate 8 secured on the door 10 when in its closed position, the walls of the square cross-section portion 224 are aligned with the walls 322 of square cross-section channel 160 of the upper closed loop 320 of the modified plate 200. The locking pin 220 is then inserted until its square cross-section portion passes into the circular interlocking channel 18 of the upper closed loop 48 of the plate 8, at which time the locking pin 220 is rotated to a pre-determined radius wherein the walls of its square cross-section portion 224 become aligned with the walls 342 of the square cross-section interlocking channel 162 of the lower closed loop 340 of the modified plate 200. The locking pin 220 is then inserted further, passing its square cross-section portion 224 through the interlocking channel 162 and into the circular interlocking channel 18 of the lower closed loop 50 of the plate 8.

The modified locking pin 220 terminates in a short stub 226 of circular cross-section and smaller dimension than that of the square cross-section portion 224, to seat in a lower end recess portion 182 of corresponding cross-sectional configuration and dimension, such lower end recess portion 182 being formed as an extension of the lower closed loop 50 of plate 8 for use with the modified plate 200 and modified locking pin 220. The lower end recess portion 182 holds the stub 226 of the modified locking pin 220 snugly in place.

The modified locking pin 220 can be rotated when fully inserted to rotate its square cross-section portion 224 out of alignment with the square cross-section locking channel 162. The modified locking pin 220 cannot now be withdrawn, but is locked in place until rotated to the pre-determined radius of rotation wherein the square cross-section portion 224 is again aligned with the square cross-section interlocking channel 162. The locking pin 220 can then be withdrawn until its square cross-section portion 224 reaches the circular cross-section interlocking channel 18 of the upper closed loop 48 of the plate 8. The locking pin 220 now has to be rotated again to a second pre-determined radius of rotation to align its square cross-section portion 224 with the square cross-section of interlocking channel 160 of the upper closed loop 320 of the modified plate 200, before it can be fully withdrawn to unlock the door 10.

The modified locking pin 220 as shown in FIG. 11 also includes an annular collar 228 at its upper end region to seat in a corresponding annular recess 164 of the upper closed loop 320 of the modified plate 200. Thus, when the modified locking pin 220 is fully seated in the interlocking channels, the projecting stub 226 received in the recess 182 at the lower end and the annular collar 228 received in the annular recess 164 at the upper end holds the modified locking pin 220 in stable axial alignment within the interlocking channels.

The pin locking construction described herein utilizes cross-sections having a square configuration for the respective alternating channels and for the relevant portion of the locking pin. A wide variety of specially designed cross-sectional configurations may be used which are other than circular, or which are non-circular. The respective cross-sections of the relevant parts can simply have a radially enlarged segment, such as an oval shape, or circular but with a single radial extension such as a radially projecting lug on one part, such as the pin, and radially projecting recess in the shape of such lug on the other corresponding part, such as the receiving channel.

I claim:

1. A door lock assembly, comprising a first locking member, first pin receiving means thereon to receive a locking pin therein, a second locking member, second pin receiving means on said second locking member to receive a locking pin therein, including said locking pin, and pin locking means to lock said pin in said first and second pin receiving means when received therein, wherein said first pin receiving means includes a first passageway and an axially aligned second passageway spaced apart therefrom, said second pin receiving means includes a third passageway and an axially aligned fourth passageway spaced apart therefrom, said third passageway of said second pin receiving means being receivable between said first and second passageways of said first pin receiving means, and said second passageway of said first pin receiving means being receivable between said third and fourth passageways of said second pin receiving means when said first and second locking members are in locking position, said first, second, third and fourth passageways being then axially aligned, said locking pin having a first portion to seat in said fourth passageway when fully seated in said passageway after passing through said first, second and third passageways, said pin locking means including a radially enlarged segment of the cross-section of said first portion of said locking pin, said first and second passageways having a cross-section corresponding to the configuration and dimension of said first portion of said locking pin to enable sliding therethrough when said first portion of said locking pin is rotated to align said enlarged segment of its cross-section with that corresponding portion of said first and second passageways, said corresponding enlarged segment of said cross-section of said second passageway being rotationally offset from that of said first passageway whereby when said first portion of said locking pin has passed through said first passageway it has to be rotated to align said enlarged segment of its cross-section with the corresponding portion of said second passageway, said third and fourth passageways having a cross-section wider than said enlarged segment of said first portion of said locking pin to permit rotation thereof when said first portion of said locking pin is received in said third and fourth passageways, said locking pin being locked in said passageways when said first portion is received in said fourth passageway until rotated to a pre-determined radial position in which said enlarged segment of said cross-section of said first portion of said locking pin is aligned with said corresponding enlarged segment of said cross-section of said second passageway and when received through said second passageway during withdrawal into said third passageway rotated a second time to a second pre-determined radial position in which said enlarged segment of said cross-section of said first portion of said locking pin is aligned with said corresponding enlarged segment of said cross-section of said first passageway.

* * * * *